US006592117B2

(12) United States Patent
Kuo et al.

(10) Patent No.: US 6,592,117 B2
(45) Date of Patent: Jul. 15, 2003

(54) METHOD AND APPARATUS FOR DESKEWING MEDIA IN A FEEDING MECHANISM

(75) Inventors: Ying-Hsien Kuo, Taipei (TW); Tsung-Te Lin, Taipei Hsien (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 09/820,073

(22) Filed: Mar. 27, 2001

(65) Prior Publication Data

US 2001/0055108 A1 Dec. 27, 2001

(30) Foreign Application Priority Data

May 3, 2000 (TW) ..... 89108359 A

(51) Int. Cl.[7] ..... B65H 5/00
(52) U.S. Cl. ..... 271/10.01; 271/121; 271/116
(58) Field of Search ..... 271/121, 242, 271/10.01, 10.03, 10.11, 116

(56) References Cited

U.S. PATENT DOCUMENTS 5,290,024 A * 3/1994 Takahashi ..... 271/116
5,482,265 A * 1/1996 Nakazato et al. ..... 271/242
5,498,123 A 3/1996 Alicea ..... 414/797.7
6,092,803 A * 7/2000 Munenaka et al. ..... 271/242
6,168,146 B1 * 1/2001 Komuro et al. ..... 271/10.12
6,213,458 B1 * 4/2001 Tamura et al. ..... 271/10.11
6,260,840 B1 * 7/2001 Suga et al. ..... 271/10.01
6,378,858 B1 * 4/2002 Suga ..... 271/10.01

FOREIGN PATENT DOCUMENTS

| | | |
|---|---|---|
| TW | 304515 | 5/1997 |
| TW | 324690 | 1/1998 |
| TW | 339184 | 8/1998 |

* cited by examiner

*Primary Examiner*—Christopher P. Ellis
*Assistant Examiner*—Richard Ridley
(74) *Attorney, Agent, or Firm*—Ladas & Parry

(57) ABSTRACT

A media feeding mechanism mainly comprises a base provided with a first surface and a second surface, a first roller, a second roller, a first one-way bearing used to support the first roller, a second one-way bearing used to support the second roller, a cam gear and a stopper. To prevent media from wrinkling or skewing, the media transmitted by the first roller is deskewed by contacting with the idled second roller for a predetermined period of time. The first roller 11 is idled when the deskewing process concludes. Rotation of the second roller clockwise scrubs the media toward the exit point.

6 Claims, 8 Drawing Sheets

METHOD AND APPARATUS FOR DESKEWING MEDIA IN A FEEDING MECHANISM

BACKGROUND OF THE INVENTION

1. Field of the Invention

This invention relates to a feeding mechanism. More particularly, this invention relates to a feeding mechanism provided with rollers supported by one-way bearings so as to deskew the media or paper without wrinkling.

2. Description of Prior Art

Office machines, such as printers, scanners, copiers, generally include a feeding mechanism for feeding the media (or paper) into the office machines sheet by sheet in sequential order. Traditionally, the feeding mechanism comprises an SP-roller (separation-paper roller) and a feeding roller. The SP-roller picks up the media (or paper) and moves the media towards the feeding roller. The feeding roller rotates in a direction opposite to the feeding direction of the media for a period of time such that the media can be deskewed. After the deskew period, both the SP-roller and the feeding roller will change their rotating directions such that the feeding roller rotates in the feeding direction while the SP-roller rotates in a direction opposite the feeding direction. By this means, media will be stretched and moved into the office machine for further processing, such as printing or scanning.

However, the deskewing operation generally causes the media to wrinkle on the leading edge, and in the worse case the media fails to be fed by the feeding roller. The stretch operation also interferes with the forward movement of the media, and in worse cases the media is torn.

SUMMARY OF THE INVENTION

The present invention modifies the operation of the SP-roller, the feeding roller, and the corresponding mechanism to improve the performance of the feeding mechanism and overcome the above problems. According to one embodiment of the present invention, the feeding mechanism includes a base provided with a first surface, a second surface, a first roller, a second roller, a first one-way bearing supporting the first roller, a second one-way bearing supporting the second roller, a cam gear and a stopper. The embodiment uses one-way bearings to control the rotation of the SP-roller and the feeding roller. During the deskew operation, the feeding roller does not rotate when the media is moved ahead by the SP-roller. During the stretching operation, the SP-roller is idled and can freely rotate when the media is moved further ahead by the feeding roller. Accordingly, the media can be transmitted smoothly from the paper tray into the office machine.

BRIEF DESCRIPTION OF THE DRAWINGS

The present invention can be more fully understood by reading the subsequent detailed description and examples with reference made to accompanying drawings in which.

DETAILED DESCRIPTION OF THE PREFERRED EMBODIMENTS

Figure 1A:
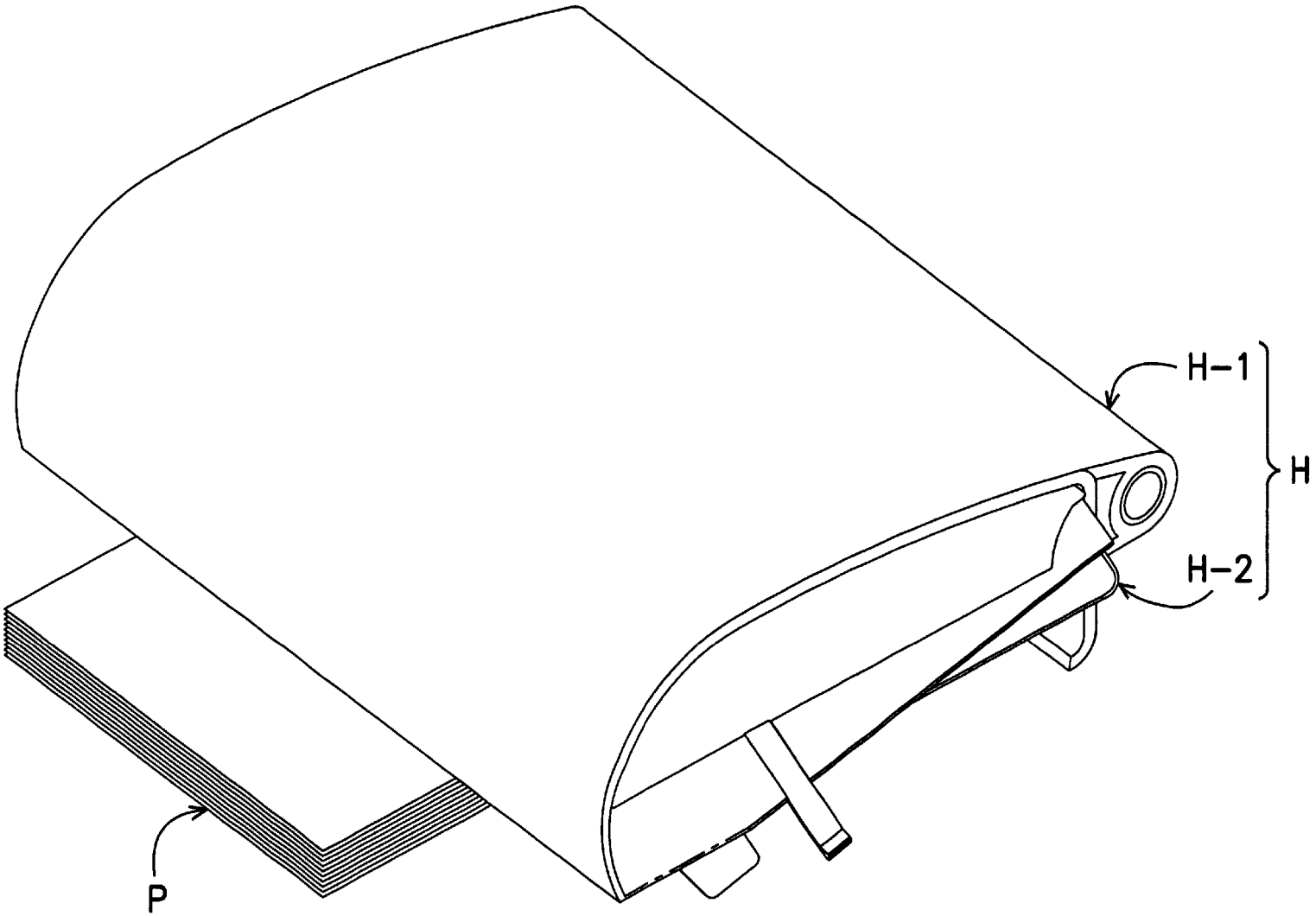
FIG. 1A is a perspective view showing the outer structure of a feeding mechanism (1) of, the present invention, comprising an upper housing (H-1) and a lower housing (H-2)

FIG. 1A is a perspective view showing the outer structure of a feeding mechanism 1 of the present invention. An upper housing H-1 and a lower housing H-2 are constructed on the outer structure of the feeding mechanism 1. A stack of media P, such as sheets of paper, can be fed by the feeding mechanism 1 to a printing device (not-shown).

Figure 1B:
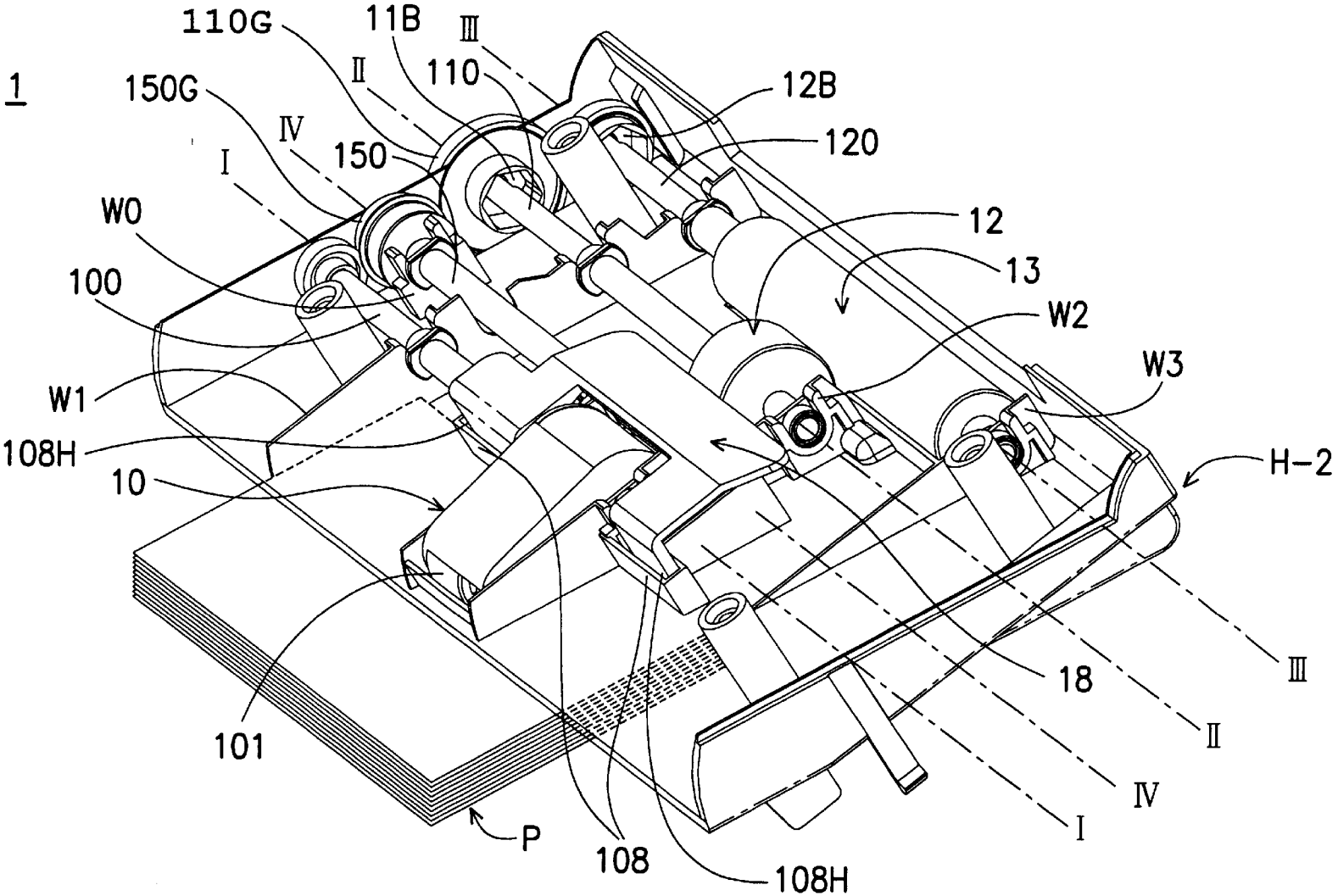
FIG. 1B is a perspective view showing the inner structure of the feeding mechanism (1) without the upper housing (H-1) according to FIG. 1A.
Figure 1C:
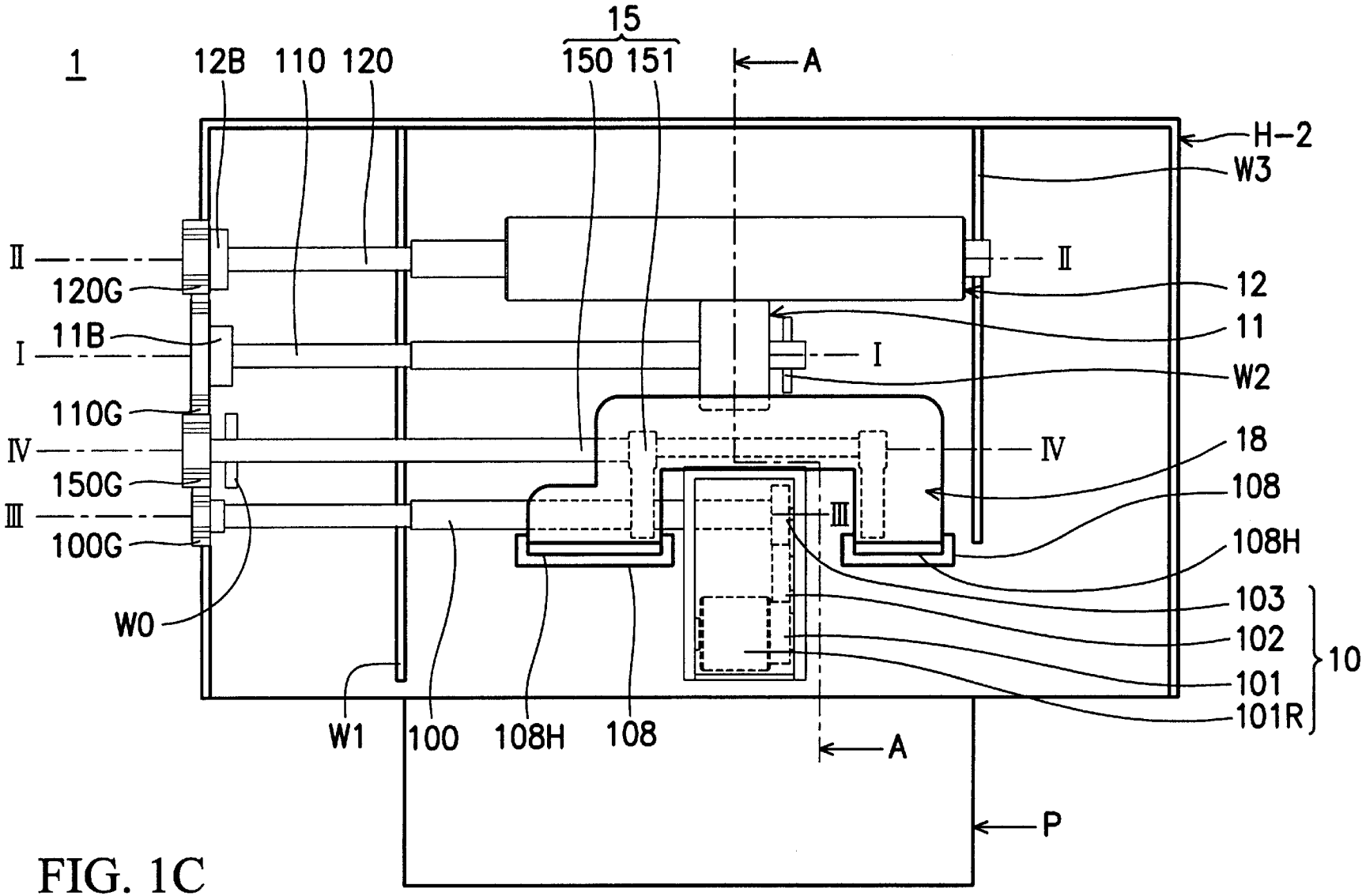
FIG. 1C is a top view of FIG. 1B.

FIG. 1B is a perspective view showing the inner structure of the feeding mechanism 1, from which the upper housing H-1 is taken off. FIG. 1C is a top view of FIG. 1B. The lower housing H-2 is used as a base so as to support all the elements of the feeding mechanism 1. Besides the upper housing H-1 and the lower housing H-2, the feeding mechanism 1 further comprises a feeder 10, a first roller 11, a second roller 12, a first one-way bearing 11B, a second one-way bearing 12B, a cam gear 15 (see FIG. 1C) and a stopper 18. The stopper 18 is an L-shaped plate, which can be actuated by the cam gear 15 and removably received in the two holes 108H of the guiding seats 108 so as to align the media before the media starts the feeding procedure. All elements are supported by the lower housing H-2 and covered by the upper housing H-1.

Four supporting seats W0, W1, W2 and W3 are respectively arranged on the inner bottom surface of the lower housing H-2 substantially parallel to each other. Four cylindrical shafts 110, 120, 100 and 150 are mounted on the bottom of the lower housing H-2 and are capable of respectively rotating about a first axis I—I, a second axis II—II, a third axis III—III and a fourth axis IV—IV. The cylindrical shafts 110, 120, 100, and 150 are arranged substantially parallel to each other and are supported by the supporting seats W2, W3, W1, and W0.

The relationships among the four shafts (110, 120, 100 and 150) and of the elements relative to each of shafts will be depicted as follows.

[Shaft 100]

In FIG. 1B and FIG. 1C, a gear 100G and the feeder 10 are respectively mounted on two ends of the shaft 100. A transmission device (not shown) can actuate the gear 100G to rotate about the axis III—III.

The feeder 10 comprises three pulleys 101, 102, 103 and a feeding roller 101R. The pulley 103 is used as a driving element directly connected to the shaft 100. The pulley 102 is used as an idler engaged between the pulleys 101 and 103. The feeding roller 101R affixed to the pulley 101 is used as a passive element to feed the media.

Once the gear 100G is energized, the shaft 100 can directly actuate the feeder 10 to rotate within a predetermined range with respect to the third axis III—III, and the feeding roller 101R can be controlled and rotated to scrub the media P and bring the media P into the feeding mechanism 1.

[Shaft 150]

In FIG. 1C, the cam gear 15 has two cam portions 151 spaced apart and fixedly mounted on one end of the shaft 150, and the L-shaped stopper 18 is freely and uniformly disposed on the two cam portions 151. Another gear portion 150G is mounted on the other end of the shaft 150 and engages with the gear 100G.

As the gear portion 150G is actuated, the cam portions 151 can be rotated within a determined range by the shaft 150, and the stopper 18 can be lifted or lowered by the cam portions 151 according to the rotation direction of the gear 105G.

[Shaft 110 and 120]

The first roller 11 is arranged on the first shaft 110, and the supporting seats W1 and W2 are used together to support the shaft 110. The first one-way bearing 11B is disposed between the shaft 110 and a gear portion 110G, which is engaged to the gears 150G. When the gear portion 110G rotates clockwise, the shaft 110 and the first roller 11 will be driven to rotate clockwise accordingly. However, due to the one-way bearing 11B, when the gear portion 110G rotates counterclockwise, the shaft 110 and the first roller 11 will not be driven to rotate counterclockwise accordingly.

The second roller 12, which is larger than the first roller 11, is arranged on the second shaft 120, and the supporting seats W1 and W3 are used together to support the shaft 120. The second one-way, bearing 12B is disposed between the second shaft 120 and a gear portion 120G, which is engaged to the gear portion 110G. When the gear portion 120G rotates clockwise, the shaft 120 and the second roller 12 will be driven to rotate clockwise accordingly. However, due to the one-way bearing 12B, when the gear portion 120G rotates counterclockwise, the shaft 120 and the second roller 12 will not be driven to rotate counterclockwise accordingly.

Figure 2:
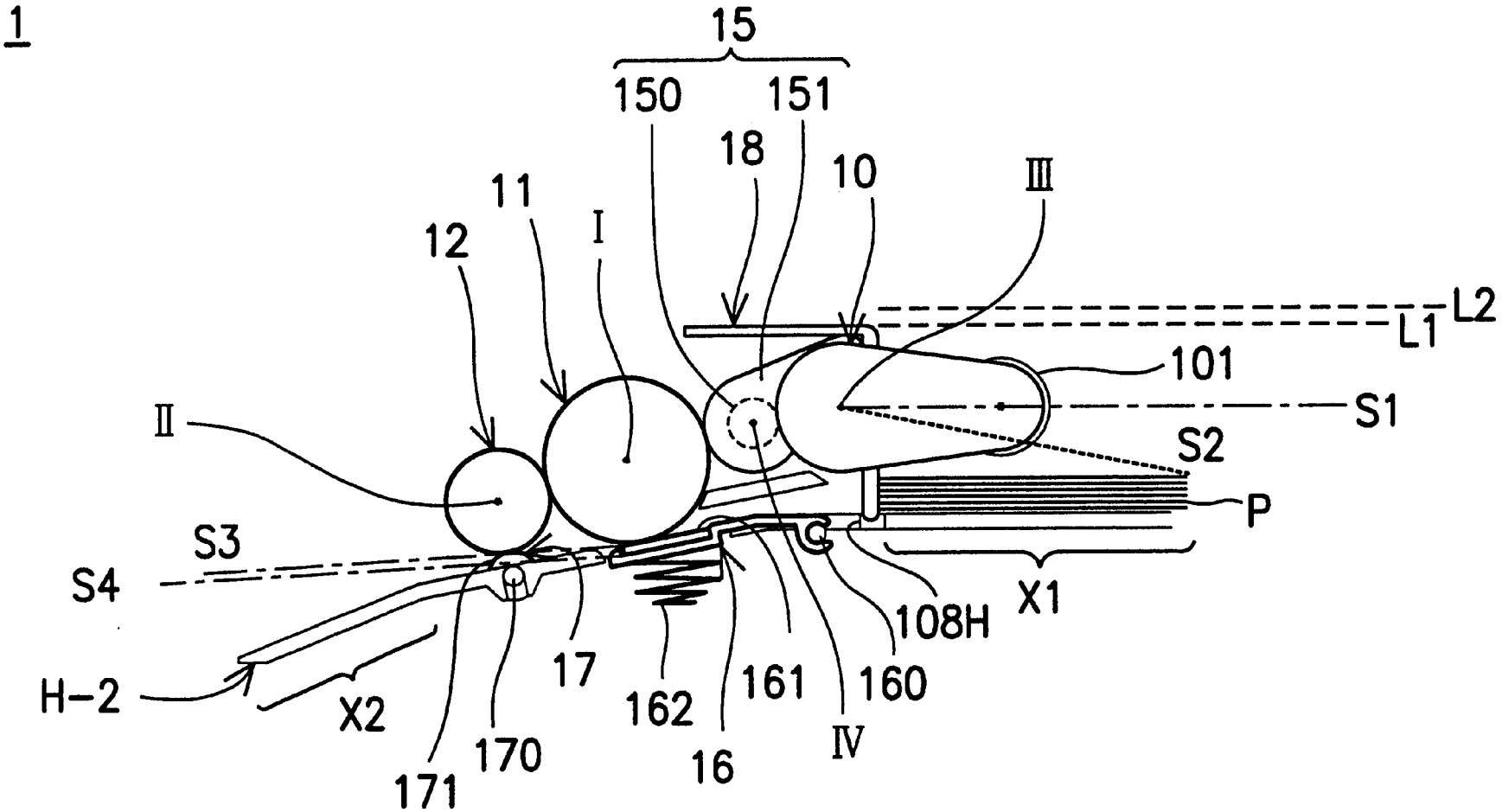
FIG. 2 is a side view of the feeding mechanism (1) according to a sectional line (A—A) of FIG. 1C, wherein the feeding mechanism (1) is used to transmit the media (P) or papers from an entry point (X1) to a exit point (X2) sequentially by a feeder (10), the first roller (11) and the second roller (12)

FIG. 2 is a side view of the feeding mechanism 1 according to a, sectional line A—A of FIG. 1C.

The feeder 10 rotated about the third axis III—III can be moved within a predetermined, range angled from line S1 to line S2, and the stopper 18 can be lifted up or put down by the cam portions 151 at the range between level L1 and level L2.

The lower housing H-2 is provided with an entry point X1, a exit point X2, a first surface 161 and a second surface 171, wherein the first surface 161 and the second surface 171 are located between the entry point X1 and the exit point X2. The entry point X1 receives the media P before entry into the feeder 10, and the exit point X2 is a destination to receive the media P, for example a place for the office machine to perform processes such as printing or scanning.

A plate 16 pivoted on an axis 160 and suspended by a spring 162 and a guiding roller 17 pivoted on another axis 170 are mounted on the lower housing H-2, respectively. The plate 16 is provided with the first surface 161, which is elastically and separately contacts the first roller 11 by the spring 162 and is capable of moving within a predetermined range between line S3 and line S4. The guiding roller 17 is provided with the second surface 171, which is elastically and separately contacted with the second roller 12. Media with different thickness, therefore, can smoothly pass through the clearance between the first roller 11 and the first surface 161 and between the second roller 12 and the second surface 171.

FIGS. 3A to 3D are four figures sequentially depicting four steps for feeding the media P from the entry point X1 to the exit point X2 by the feeding mechanism 1. The feeding mechanism 1 in these figures is covered with the upper housing H-1.

Figure 3A:
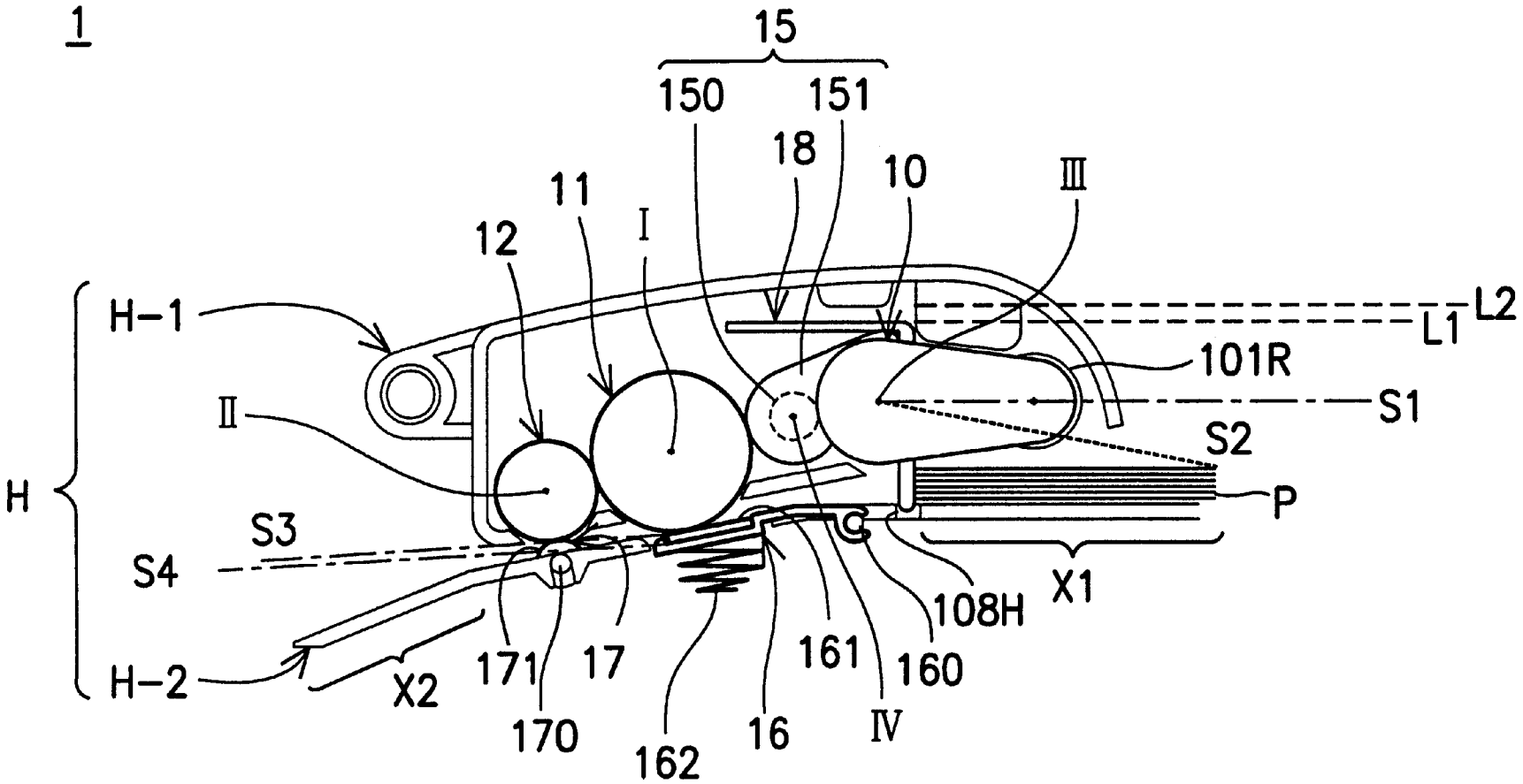
FIGS. 3A to 3D are four figures sequentially depicting the steps for feeding the media (P) or papers from the entry point (X1) to the exit point (X2) by the feeding mechanism (1).
Figure 3B:
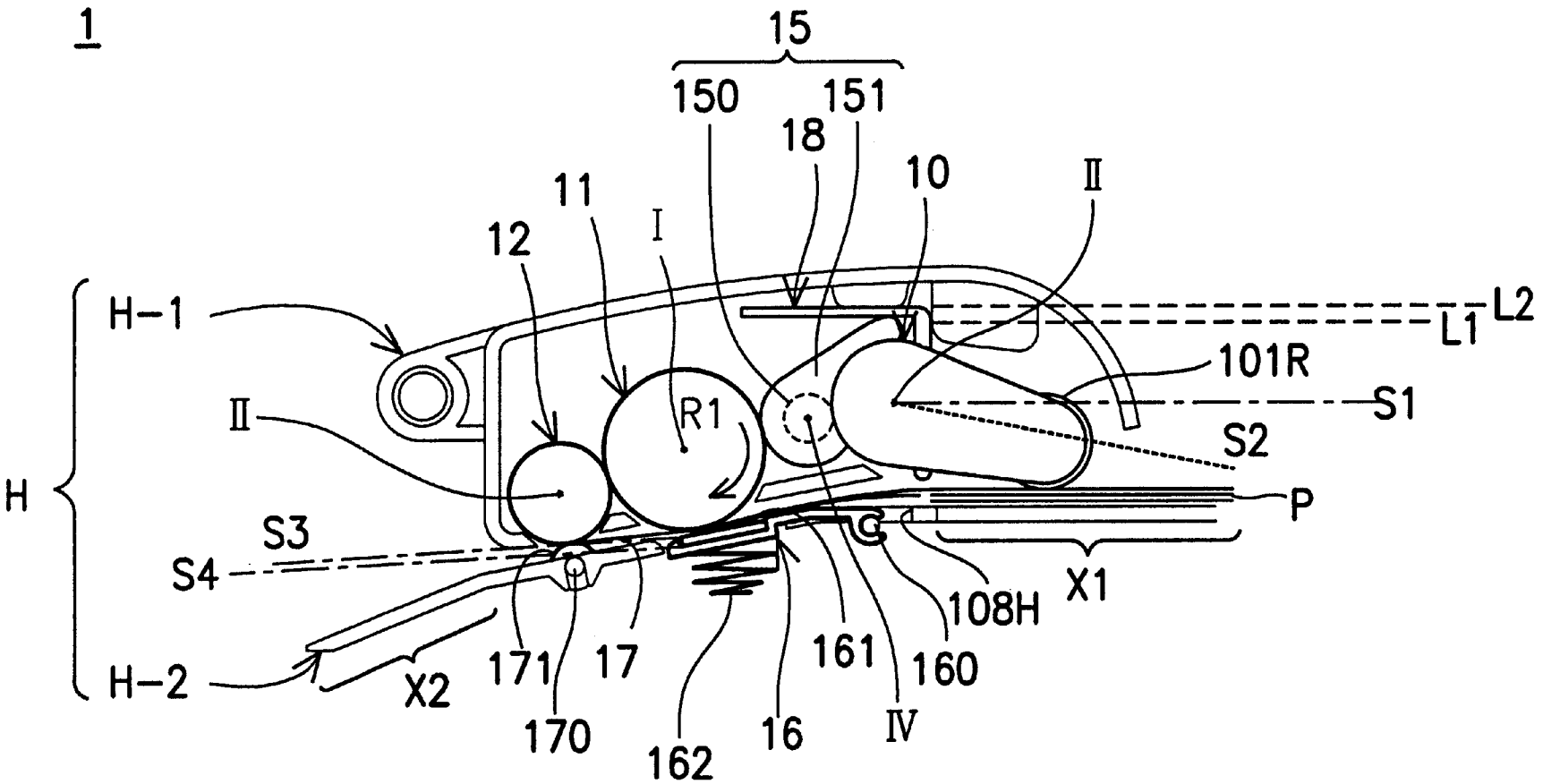

As shown in FIG. 1C and FIG. 3B, the gear portion 120G rotates counterclockwise before the feeding roller 101R scrubs the media P, and the gear portion 150G is rotated counterclockwise by the gear portion 120G. Then, the stopper 18 is elevated from level L1 to level L2 by the moving cam portions 151, and the feeding roller 101R scrubs on the media P (the top sheet) and passes it toward the first roller 11 when the stopper 18 is at level L2. Then, the first roller 11 pressed on the first surface 161 generates a first frictional force to scrub the media P transmitted from the feeder 10 to a second roller 12. The media P is clamped by the first roller 11, which is rotating clockwise, and the plate 16, and thus is transmitted toward the second roller 12. Though the gear 120G rotates counterclockwise, the shaft 120 and the second roller 12 are not driven to rotate counterclockwise because of the one-way bearing 12B. The media P clamped between the first roller 11 and the first surface 161 is kept moving toward the second roller 12 by the clockwise rotation of the first roller 11 until the leading edge of the media P contacts the second roller 12 and the guiding roller 17. Though the second roller 12 is idling and is capable of rotating clockwise, the transmitted media does not have enough force to push the second roller 12 to rotate clockwise, so the second roller is in fact kept still at this time.

On arriving at the second roller 12 and the guiding roller 17, the position of the media P transmitted by the first roller 11 may be skewed with respect to the first axis I—I. Continued clockwise rotation of the first roller 11 with the media P contacting the second roller 12 and the guiding roller 17 for a predetermined period of time will automatically deskew media P by making the leading edge of the media P substantially parallel to the first axis I—I. In this way, the leading edge of the media is deskewed and will not wrinkle. In this embodiment the second roller 12 does not rotate in a direction contrary to the moving direction of the media P, so the possibility of wrinkling the leading edge of the media P is much lower.

Figure 3C:
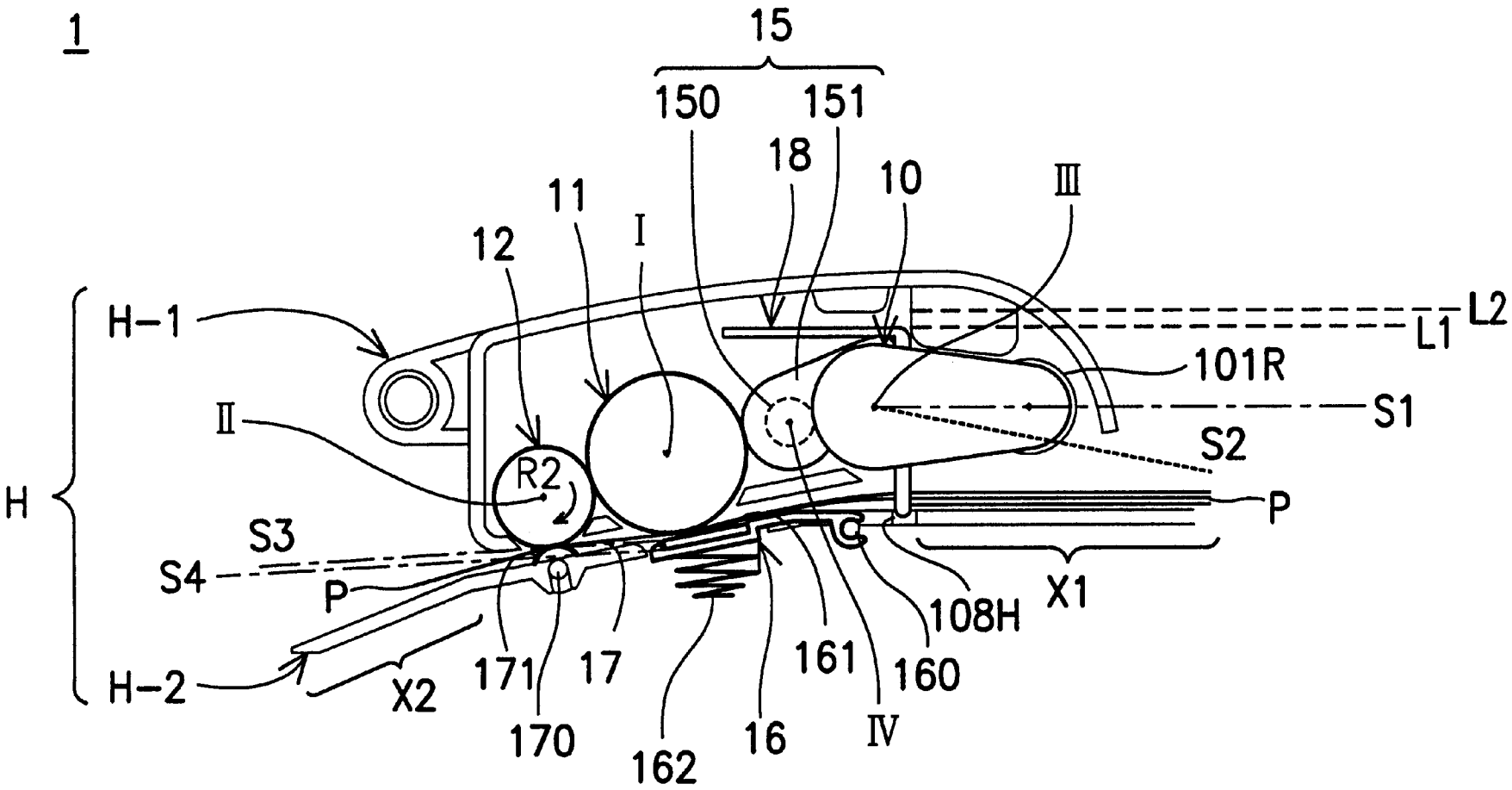

Then, the gear portion 120G rotates clockwise and the second roller 12 begins rotating in the clockwise direction R2 and transmits the media P toward the exit point X2 by pressing the media P on the guiding roller 17. The second roller 12 presses the media P on the guiding roller 17 of the second surface 171 to generate a second frictional force to scrub the media P transmitted from the first roller 11 to the exit point. When the gear portion 120G rotates clockwise, the second roller 12 rotates clockwise accordingly and the gear portion 110G will be driven to rotate counterclockwise. The first one-way bearing 12B prohibits the first roller 11 from rotating counterclockwise, so the friction between the media P and the first roller 11 will bring the first roller 11 to rotate clockwise as well. As shown in FIG. 3C, the portion of the media P still clamped between the first roller 11, and the plate 16 is driven in the direction of exit point X2 by the clockwise rotation of the second roller 12.

Figure 3D:
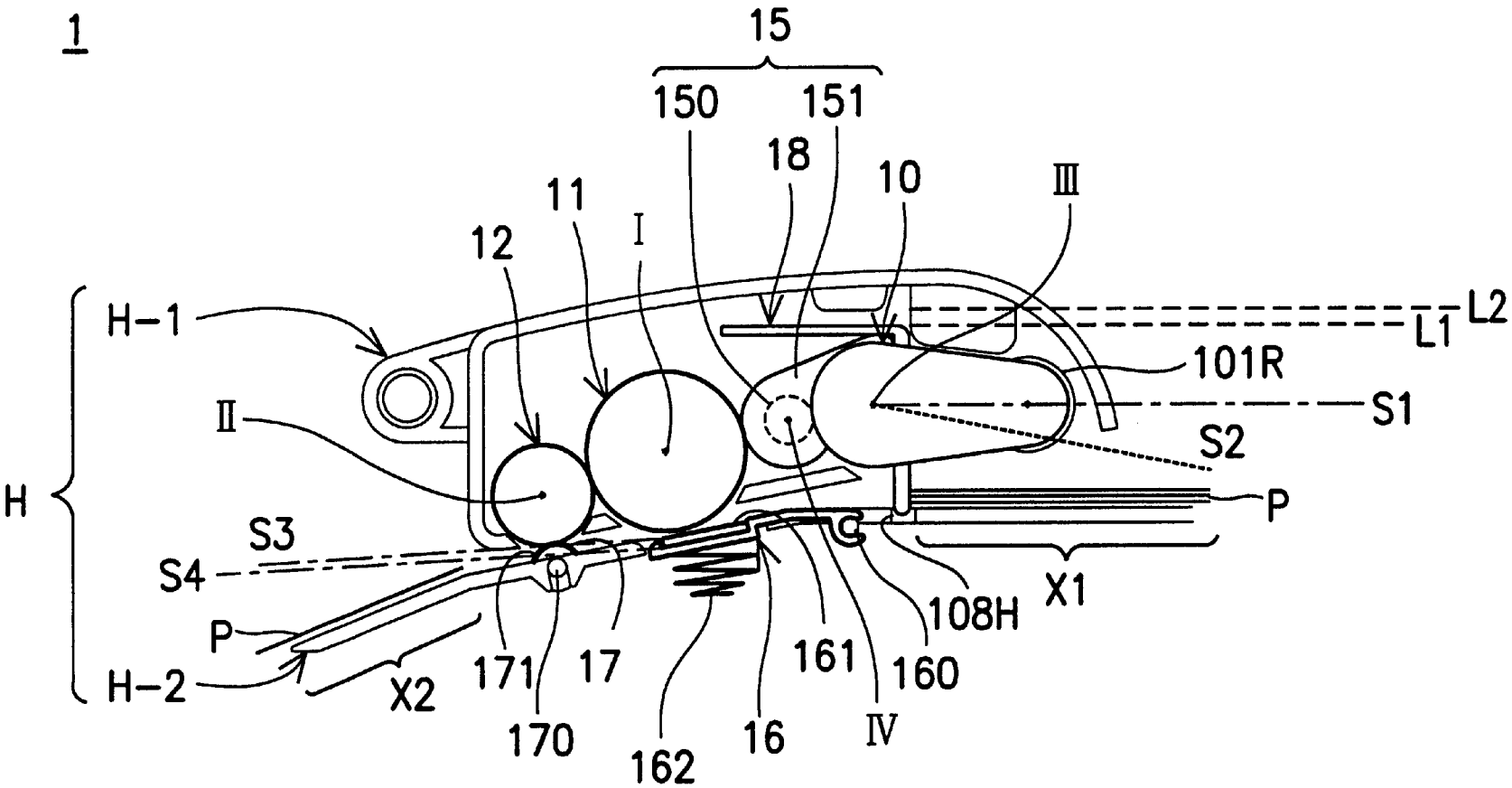

As shown in FIG. 3D, the media P then arrives at the exit point X2 without wrinkling after exiting the clamp between the second roller 12 and guiding roller 17. By this process, all media P stacked at the entry point X1 can be orderly fed to exit point X2.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the appended claims.

What is claimed is:

1. An apparatus for feeding media from an entry point, comprising:

a first gear portion and a second gear portion, each of the first gear portion and the second gear portion capable of rotating in a clockwise direction and a counterclockwise direction;

a first one-way bearing disposed on the first gear portion;

a second one-way bearing disposed on the second gear portion;

a first roller driven by the first one-way bearing, wherein when the first gear portion is rotated in a first direction among the clockwise direction and the counterclockwise direction the first roller is driven by the first one-way bearing and rotates to scrub the media from the entry point, and when the first gear portion is rotated in a second direction among the clockwise direction and the counterclockwise direction, different from the first direction, the first roller idles without rotation; and a second roller driven by the second one-way bearing, wherein when the second gear portion is rotated in a first direction among the clockwise direction and the counterclockwise direction the second roller is driven by the second one-way bearing and rotates to scrub the media transmitted from the first roller, and when the second gear portion is rotated in a second direction among the clockwise direction and the counterclockwise direction, different from the first direction, the second roller idles without rotation.

2. The apparatus as claim 1, wherein only one of the first gear portion and the second gear portion is rotated, such that only one of the first roller and the second roller is driven and rotated to scrub the media.

3. The apparatus as claimed in claim 1, wherein the first gear portion directly engages with the second gear portion, thereby rotating the first and the second gear portions in opposite directions.

4. The apparatus as claimed in claim 1 further comprising a feeder for scrubbing the media from the entry point toward the first roller.

5. The apparatus as claimed in claim 1 further comprising a first shaft and a second shaft, the first one-way bearing mounted on the first shaft, and the second one-way bearing mounted on the second shaft.

6. The apparatus as claimed in claim 4 wherein the first roller is also mounted on the first shaft, and the second roller is also mounted on the second shaft.

* * * * *